United States Patent [19]

Panzarella

[11] 4,132,389

[45] Jan. 2, 1979

[54] SELF-LOCKING WINDLASS

[75] Inventor: James S. Panzarella, East Aurora, N.Y.

[73] Assignee: The Quaker Oats Company, Chicago, Ill.

[21] Appl. No.: 876,740

[22] Filed: Feb. 10, 1978

[51] Int. Cl.[2] ..... B66D 1/00

[52] U.S. Cl. ..... 254/186 HC; 242/96; 24/68 R

[58] Field of Search ..... 254/161, 163, 164, 169, 254/186 HC, 186 R, 173 R, 150 R; 242/96, 106; 24/68 R, 68 CD, 70 R, 132 R, 265 R; 105/477

[56] References Cited

U.S. PATENT DOCUMENTS

| | | | |
|---|---|---|---|
| 75,869 | 3/1868 | Curley | 254/190 R |
| 3,746,309 | 7/1973 | Johnson | 254/150 R |
| 3,985,341 | 10/1976 | Akre | 254/161 |

FOREIGN PATENT DOCUMENTS

| | | | |
|---|---|---|---|
| 985024 | 7/1951 | France | 254/161 |

*Primary Examiner*—Trygve M. Blix
*Assistant Examiner*—Kenneth W. Noland
*Attorney, Agent, or Firm*—Cumpston & Shaw

[57] ABSTRACT

A self-locking windlass for preventing unwinding of the windlass under load when the force turning the windlass is released. The windlass comprises an eccentric spindle coupled to a shaft and rotatable therewith. A cable has one end secured to the spindle and its opposite end securable to the load. Upon rotation of the shaft and spindle, the cable is wound on the spindle pulling the load toward the windlass. Due to the eccentric spindle, a self-locking position of the windlass is attained during each revolution of the shaft and spindle. In this locking position, the load is incapable of unwinding the cable when the force rotating the shaft and spindle is released. This locking position is attained when the spindle is substantially between the shaft and load and the load force is directed toward the load along a line that is substantially tangent to the spindle and passes through the shaft.

4 Claims, 5 Drawing Figures

SELF-LOCKING WINDLASS

BACKGROUND OF THE INVENTION

1. Field of the Invention

This invention relates generally to a windlass, and more particularly to a self-locking windlass.

2. Description of the Prior Art

The windlass comprising a crank rotatable drum about which a cable is wound for use in pulling or raising loads of various types such as water buckets, anchors, boats or the like are well known in the art. With such a windlass, a problem arises in those situations where the cranking force is inadvertently released causing the load to suddenly drop or slide due to gravity. This results in rapidly unwinding the cable from the drum possibly causing one or more of the following, namely — damage to the load when it strikes a stop member, damage to an operator who may be struck by the rotating crank, and damage to the windlass when the cable reaches the end of its travel. These problems have been overcome in the prior art by a locking mechanism comprising a ratchet wheel and pawl for preventing reverse rotation of the drum. Additional mechanism is needed to deactivate the pawl to permit unwinding the cable. Applicant's self-locking windlass prevents rapid unwinding of the cable without the necessity of the prior art locking mechanism or pawl deactivating mechanism.

SUMMARY OF THE INVENTION

In accordance with a preferred embodiment of the invention a self-locking windlass is disclosed comprising a rotatable shaft and an eccentric spindle coupled thereto for rotation therewith. A cable has one end secured to the spindle and its opposite end securable by a hook or the like to any suitable load. Upon rotation of the shaft and spindle, the cable is wound on the spindle pulling the load toward the windlass which is suitably anchored against movement. By virtue of the eccentric location of the spindle relative to the shaft, a locking position of the windlass is attained during each rotation of the spindle about the shaft. During such locking position, the load cannot move away from the windlass under the influence of any force such as gravity when the rotational force applied to the windlass for rotating the spindle is released or removed. The locking position is achieved when the spindle is substantially between the shaft and load. In this position, any force applied to rotate the spindle is directed in opposition to the load force, which is directed along a line substantially tangent to the spindle and extending through the axis of the shaft.

In a more specific aspect of the invention, the spindle is directly coupled to the shaft by a flange plate for guiding the cable on the spindle.

The invention and its advantages will become more apparent from the detailed description of the preferred embodiment presented below.

BRIEF DESCRIPTION OF THE DRAWINGS

In the detailed description of the preferred embodiment of the invention presented below, reference is made to the accompanying drawing, in which.

DESCRIPTION OF THE PREFERRED EMBODIMENT

Figures 1, 2, 3, 4, 5:
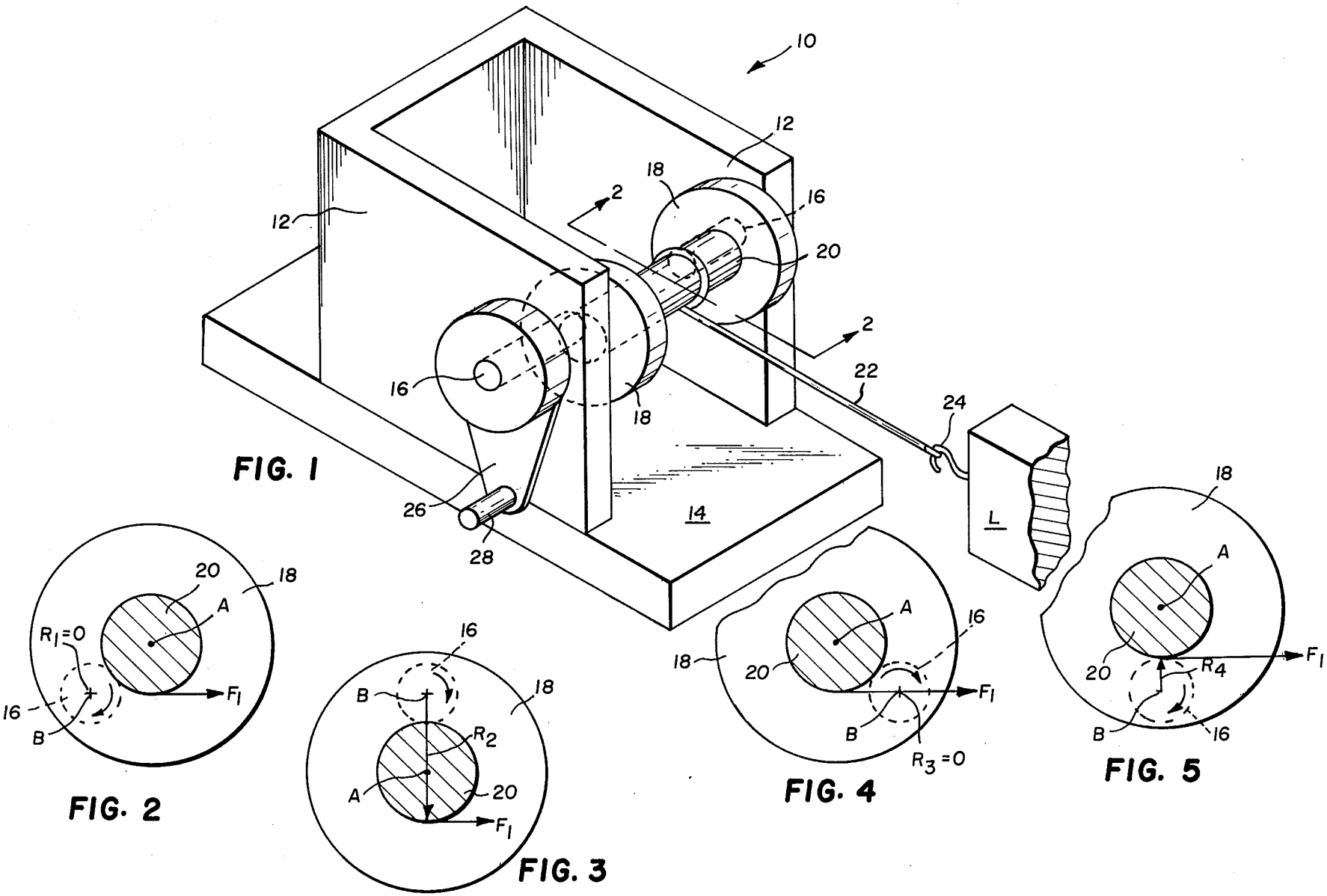
FIG. 1 is a perspective view of the self-locking windlass of the invention secured to a load.
FIG. 2 is a section view taken substantially along line 2—2 of FIG. 1 when the windlass is in its self-locking position.
FIGS. 3–5 are views similar to FIG. 2 of various positions of the spindle during a single clockwise revolution of the spindle.

With reference to FIG. 1, a preferred embodiment of a self-locking windlass 10 of this invention is disclosed for use in applying a force to any suitable load L such as a boat, a bucket containing material, an anchor or the like for moving the load toward the windlass.

The windlass 10 comprises spaced apart side frames 12 secured or anchored to a rigid base 14 which in turn is secured to any suitable support, not shown. The frames 12 rotatably support aligned stub shafts 16 journaled in bearings in the frames. The inner ends of stub shafts 16 are secured to spaced apart flange plates 18 arranged perpendicular to shafts 16. Although flange plates 18 are circular, they can be of any other suitable outer peripheral configuration or shape.

A spindle 20 is provided which is rotatable in unison with shafts 16 and plates 18. Each end of spindle 20 is secured by welding or the like to one of the plates 18. The spindle 20 is parallel to aligned shafts 16 and is preferably concentric to plates 18. The spindle axis A is radially spaced from the axis B of shafts 16; that is, the spindle axis A is eccentric to axis B of the shafts 16.

A cable 22 is provided for securing spindle 20 to any suitable load L such as a boat, boat anchor, bucket or the like which is to be pulled toward windlass 10. One end of cable 22 is secured by a bolt or the like, not shown, to the periphery of spindle 20. The opposite end of cable 22 has a hook 24 or the like which is securable to the load.

Means are provided for applying an exterior rotational force to shafts 16 for rotating the shafts, plates 18 and spindle 20 as a unit about axis B of the shafts in one direction. This causes cable 22 to wind around spindle 20, preferably in adjacent coils, for pulling the load L toward the windlass. The exterior force applying means in one of its simplest forms comprises a manually rotatable crank 26 and handle 28 rigidly secured to the outer end of one of the stub shafts 16. Crank 26 can be secured to the stub shaft in any suitable position relative to spindle 20.

A self-locking position of windlass 10 is obtained during each revolution of spindle 20 about shafts 16. In this self-locking position, the load L is incapable of unwinding cable 22 and rotating spindle 20 and shafts 16 in a counterclockwise direction due to a load force $F_1$ such as the force of gravity or any other force acting on the load L. The self-locking position is attained with reference to FIG. 2 when spindle 20 is substantially between shafts 16 and load L, and the load force $F_1$ is directed along a line that is substantially tangent to spindle 20 and passes through axis B of shafts 16. This load force direction is in opposition to any exterior force applied to rotate the shafts 16 and spindle 20 in a direction for pulling the load toward the windlass. In this position, the torque arm $R_1$ of the load force $F_1$ is "0", and hence the rotational torque $T_1$ acting on spindle 20 due to the load force $F_1$ is also "0". Any effort to move spindle 20 in either direction would require the application of a rotational torque via any exterior force applied manually or by any other suitable means. Consequently, without the application of an exterior force in opposition to load force $F_1$, spindle 20 will remain in its self-locking FIG. 2 position.

With reference to FIGS. 2–5, various positions of spindle 20 are shown as crank 26 is rotated clockwise through a single revolution. It, of course, should be understood that during operation of the windlass, the crank 26, shafts 16 and spindle 20 would be continuously rotated as a unit in a clockwise direction through the illustrated positions in succession for drawing the load L toward the windlass.

When crank 26, shafts 16 and spindle 20 are rotated as a unit from the FIG. 2 to the FIG. 3 position by the application of an exterior force, the load torque arm $R_2$ reaches its largest value, that is equal to the sum of the spindle diameter and shaft radius. Accordingly the torque due to the exterior force applied manually or by any other suitable means required to turn crank 26 to pulll the load toward the windlass must exceed the load torque $T_2$ due to load force $F_1$, which is equal to $F_1R_2$.

When the rotation of crank 26, shafts 16 and spindle 20 as a unit is continued by the exterior force from the FIG. 3 to the FIG. 4 position, the torque arm $R_3$ of the load force $F_1$ acting upon spindle 20 for rotating it is also "0". This position, however, is unstable since any slight movement of the spindle in either direction will cause the torque arm $R_3$ of the load force $F_1$ and the rotational load torque $T_3$ to steadily increase without the application of any additional exterior rotational force causing a sudden rotational movement of the shafts 16 and spindle 20 to the self-locking FIG. 2 position. In other words, in this unstable position, the exterior force applied to turn spindle 20 acts in the same direction as the load force $F_1$ for moving the spindle through the FIG. 4 position toward the FIG. 5 position.

As the rotation of crank 26, shafts 16 and spindle 20 is continued by the exterior force through the FIG. 4 and FIG. 5 positions, the torque arm $R_4$ of load force $F_1$ is steadily increased to its maximum, at which time it is equal to the shaft radius. Accordingly, the torque $T_4$ due to load force $F_1$ acting on spindle 20 assists the exterior force in rotating the spindle from its FIG. 4 position through the FIG. 5 position to its self-locking FIG. 2 position.

The invention has been described in detail with particular reference to a preferred embodiment, but it will be understood that variations and modifications can be effected within the spirit and scope of the invention as described hereinabove.

What is claimed is:

1. A self-locking windlass for preventing unwinding of the windlass under load comprising:

a shaft having an axis;

an eccentric spindle coupled to and rotatable with said shaft;

a cable having one end secured to said spindle and its opposite end securable to a load; and means for imparting rotation to said spindle and shaft causing said cable to be wound on said spindle for pulling said load toward the windlass, and whereby during each revolution of said spindle and shaft a locking position is attained in which the force of the load due to any cause can not unwind said cable from the windlass when the rotation imparting means is released, said locking position being attained when said eccentric spindle is substantially between said shaft and load and the load force is directed along a line that is substantially tangent to the spindle and passes through said axis.

2. The windlass according to claim 1 wherein said spindle is directly coupled to said shaft by a flange plate for guiding the cable.

3. The windlass according to claim 1 wherein a pair of spaced apart aligned shafts are provided along said axis, and each end of said spindle is directly coupled to one of said shafts by a flange plate perpendicular to said axis to form a pair of parallel, spaced apart flange plates for guiding the cable therebetween.

4. The windlass according to claim 3 wherein said flange plates are circular, and said spindle is concentric to said flange plates.

* * * * *